United States Patent [19]

Kozuka et al.

[11] Patent Number: 4,515,571

[45] Date of Patent: May 7, 1985

[54] MOVING TOY CAPABLE OF BEING NON-PERMANENTLY ASSEMBLED

[75] Inventors: Michihiro Kozuka; Masayuki Tonokura, both of Tokyo, Japan

[73] Assignee: Tomy Kogyo Co., Inc., Japan

[21] Appl. No.: 443,432

[22] Filed: Nov. 22, 1982

[30] Foreign Application Priority Data

Nov. 24, 1981 [JP] Japan ..... 56-174363[U]

[51] Int. Cl.[3] ..... A63H 33/04

[52] U.S. Cl. ..... 446/90; 446/94; 446/99

[58] Field of Search ..... 46/251, 266, 265, 264, 46/206, 208, 119, 16, 17, 150, 248, 221, 222, 223

[56] References Cited

U.S. PATENT DOCUMENTS

| | | | |
|---|---|---|---|
| 2,749,660 | 6/1956 | Zimentstark | 46/206 |
| 3,528,193 | 9/1970 | Yamakawa | 46/17 |
| 3,529,479 | 9/1970 | Ryan et al. | 46/206 |
| 4,300,308 | 11/1981 | Ikeda | 46/206 |

*Primary Examiner*—Mickey Yu

*Attorney, Agent, or Firm*—K. H. Boswell; Edward D. O'Brian

[57] ABSTRACT

A toy which can be assembled in a non-permanent manner has a body which includes a first and second body section. Each of the first and second body sections includes a mating face. The mating face on each of the body sections is complementary to the mating face of the other body section, such that the sections can be positioned in association with one another by juxtaposing the respective mating faces. A motor capable of producing an output is held in a motor cradle formed in part in one of the sections and its remaining part formed in the other of the sections. The sections are maintained together utilizing a fastening mechanism which includes one of the sections having an opening in its mating face and the other of the sections having a first joining member which is capable of passing through the opening and a second joining member capable of frictionally engaging the first joining member. At least one appendage member is operatively connected to the body and operatively associated with the motor and capable of moving with respect to the body in response to output of the motor. Movement of the appendage member with respect to the body moves the toy with respect to a support surface.

7 Claims, 9 Drawing Figures

20
22
24
26
28
30
32
34
36
38
40
42
44
46
48
48a
50
52
52a
54
56
58a
58b
60a
60b
62a
62b
64a
64b
66
68
70
72
74
76
78
80
82
84
86
88

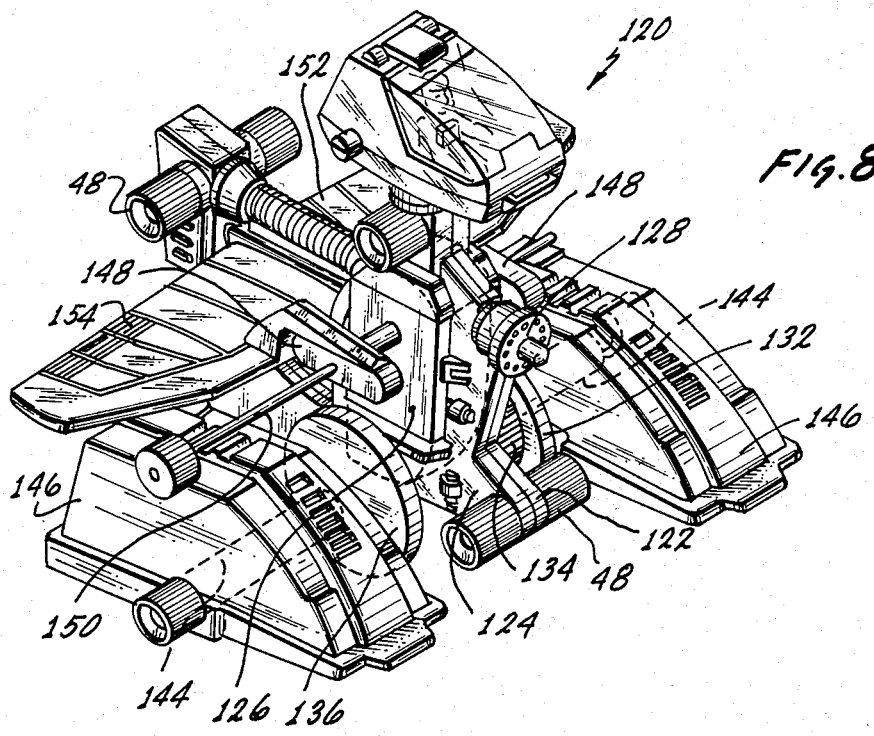
FIG. 8
FIG. 9
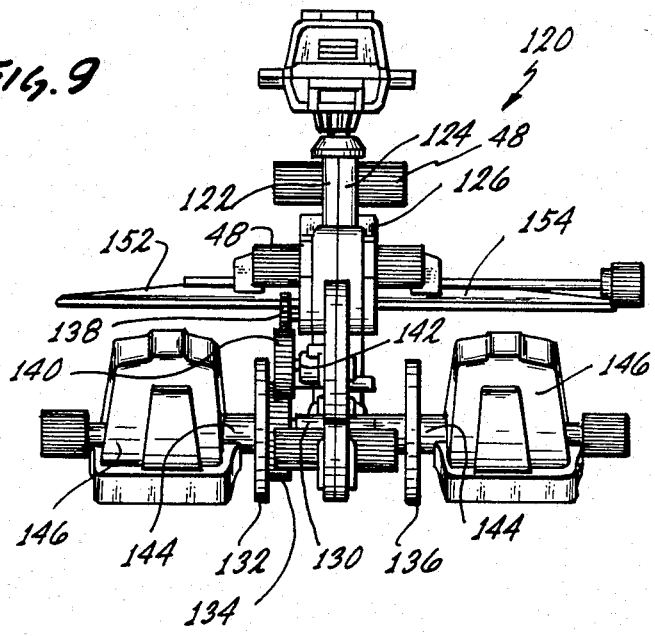

MOVING TOY CAPABLE OF BEING NON-PERMANENTLY ASSEMBLED

BACKGROUND OF THE INVENTION

This invention is directed to a toy device which can be assembled from a variety of component parts in a non-permanent assembly. A motor forms one of the component parts and interacts with at least one appendage forming another of the component parts such that movement of the appendage under the influence of the motor is capable of moving the toy.

Many toys which are capable of action and movement utilizing spring motors or small battery powered motors are known. Generally, these toys are sold to the consumer in a permanent, assembled condition. Usage of the toy would include playing with the same by activation of the motor to cause movement of the toy.

A different set of toys are known which are generally considered as models or kit toys. These are generally toys which come disassembled with a variety of component parts which are then assembled by the purchaser thereof. Normally, these toys are restricted to static type toys which are simply built and then displayed such as model airplanes, cars and the like. Normally, assembly of the model or the like is in a permanent manner, utilizing glue or snap together fittings which, once fitted together are not susceptible to easy disassembly or disassembly without the chance of breaking the parts thereof.

The action type type toys which include motors and the like have a very useful play value in allowing a child utilizing the same to fantasize different situations and the like structured around the motif of the toy. The models and the like teach certain skills in construction of the same which are not found in the action type toys. Unfortunately, the model building skills which are learned in assembling the models result in toys which are then not useful for action type play associated with the motorized type toys.

BRIEF DESCRIPTION OF THE INVENTION

In view of the above, it is a broad object of this invention to provide a toy which is assembled from component parts, and when so assembled, is capable of a motorized action. It is a further object of this invention to provide a toy which can be repeatedly assembled and disassembled without destroying the component parts thereof. It is a further object of this invention to provide such a toy which is easily and economically manufactured and therefore available to the consumer at an economical price, and which further, because it is economically manufactured, can be manufactured in a variety of different embodiments lending variety to the toy.

These and other objects, as will be evident from the remainder of this specification are achieved in a toy which comprises: a body, said body having a first and a second body section, each of said first and said second body sections including a mating face, each of said mating faces complementary to the other of said mating faces such that said first and said second body sections can be positioned in association with one another with their respective mating faces in a juxtaposed position with respect to one another;

a motor capable of producing an output;

a motor cradle means, a portion of said motor cradle means located on said first body section and the remaining portion located on said second body section, said motor cradle means capable of holding said motor in a fixed position with respect to said first and said second body sections when said mating faces are juxtaposed with respect to one another and releasing said motor when said mating faces are distal from one another;

at least one fastening means capable of reversibly fixing said mating faces of said first and said second body sections in said juxtaposed position with respect to one another, said fastening means including said second body section having an opening through its mating face and further including a first and second joining member, said first joining member located on said first body section in association with and aligned with said opening in said second body section, said second joining member frictionally engageable with said first joining member;

at least one appendage member movably connected to said body and operatively associated with said motor, said appendage member capable of moving with respect to said body in response to said output of said motor, movement of said appendage member with respect to said body moving said toy with respect to a support medium.

An additional joining member which is structurally independent from the first and second body sections, but is capable on interacting with both the first and second body sections to further contribute to maintaining the mating faces in the juxtaposed position can be included. This joining member can be constructed to include an elongated means which is capable of passing through openings formed in both the first and second body sections with one of the second joining members fixedly engaging with the elongated means to further position the first body section with respect to the second body section.

Preferredly, at least two appendage members would be movably connected to the body with each in operative association with the motor and capable of moving with respect to the body in response to the output of the motor. Movement of the appendage members with respect to the body would be capable of moving the toy with respect to a support medium.

Preferredly, the mating faces on the first and second body sections would each include flat planar areas located in complementary postions on the two sections such that the flat areas would be capable of abutting against one another.

The fastening means can include an elongated peg located on the first body section in a position allowing it to pass through an opening located in the second body section and having a portion of the peg then extend beyond the second body section when the mating faces are juxtaposed to one another. The second joining member would have an opening capable of frictionally engaging the exposed portion of the peg to hold the second joining member on the peg, which in turn holds the first and second body sections to one another.

BRIEF DESCRIPTION OF THE DRAWINGS

This invention will be better understood when taken in conjunction with the drawings wherein:

FIG. 8 is a second alternate embodiment of the invention in an oblique view with certain hidden components shown in phantom line to illustrate their position; and FIG. 9 is a rear elevation view of the embodiment of FIG. 8.

Figure 1:
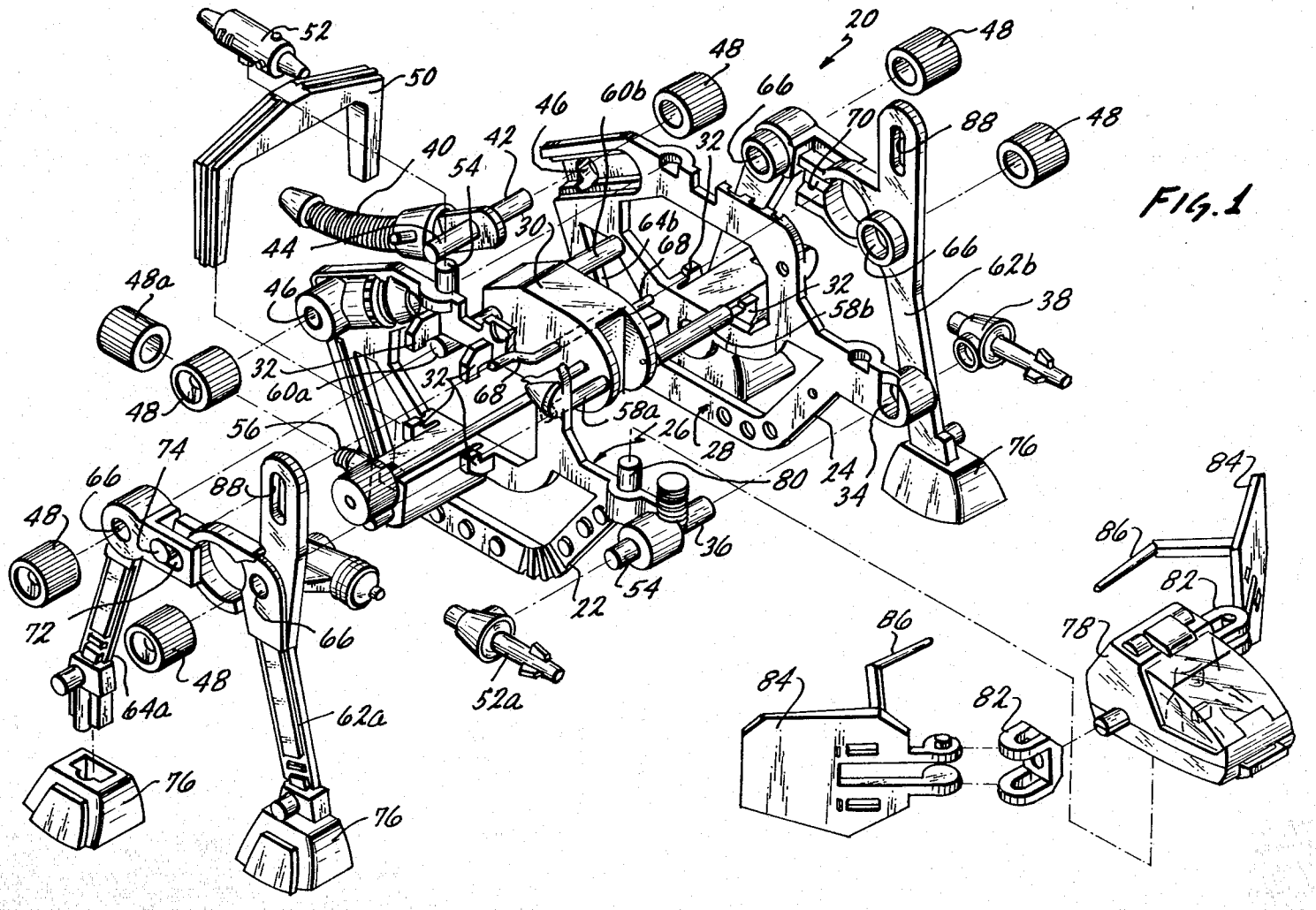
FIG. 1 is an exploded view of a toy embodying the principles of this invention.
Figure 2:
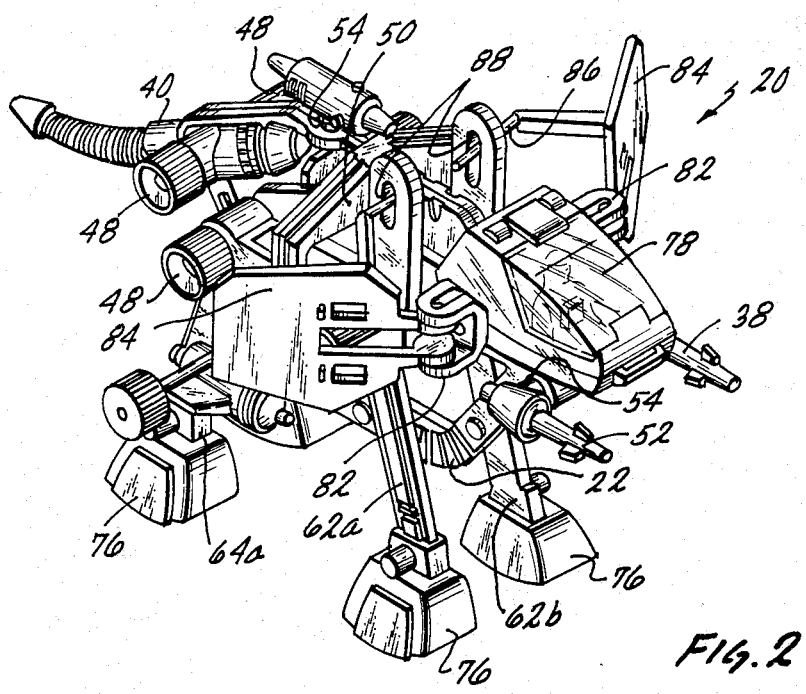
FIG. 2 is an oblique view showing the same toy as seen in FIG. 1.
Figure 3:
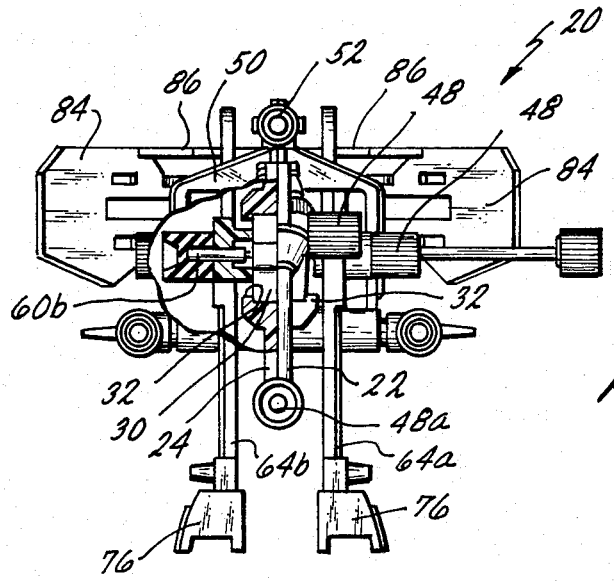
FIG. 3 is a rear elevational view in partial section showing the toy of FIG. 1.
Figure 4:
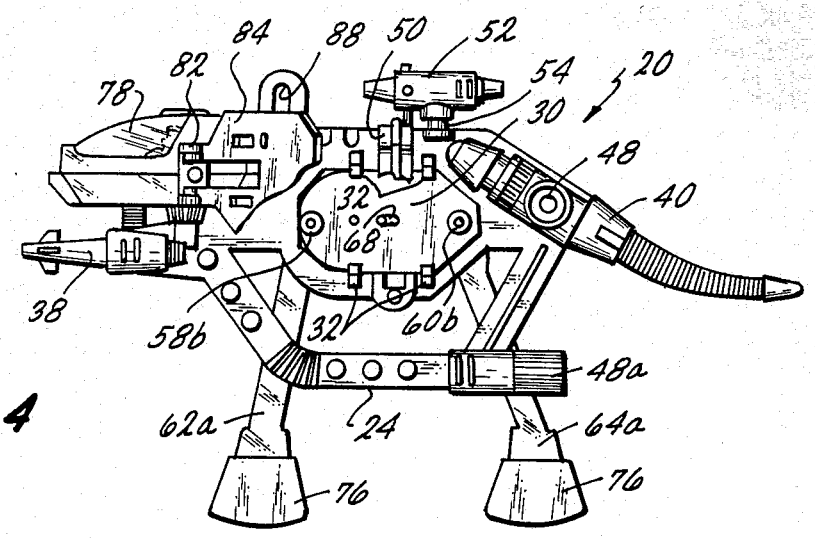
FIG. 4 is a side elevational view in partial section showing the toy of FIG. 1 with certain overlying components seen in FIG. 1 removed for clarity in FIG. 4.

The invention illustrated in the drawings and described in this specification utilizes certain principles and/or concepts as are set forth in the claims appended to this specification. Those skilled in the toy arts will realize that these principles and/or concepts are capable of being utilized in a variety of embodiments differing from the illustrative embodiments shown herein. For this reason, this invention is not to be construed as being limited to the embodiments utilized herein for illustrative purposes, but is only to be construed as being limited by the claims.

DETAILED DESCRIPTION OF THE INVENTION

In the several views of the drawings, there are shown three illustrative embodiments of this invention. The embodiments differ from each other as to their outside geometry and certain appended members. However, they share certain common structural elements which are identical in function, but differ slightly in respect to their geometric configuration. Additionally, the method of holding these elements together is common among all three of the illustrative embodiments. For this reason, the embodiment of FIGS. 1 through 4 will be described in detail, with the other two embodiments described in detail with regard to only those features which substantially differ from features shown in the first embodiment.

Certain of the structural components are common in all of the illustrative embodiments, and as such, like numerals will be utilized to identify like parts in the several views.

Generally, throughout all of the embodiments as described herein, the toys operate as follows. Each of them incorporates a wind-up spring motor which, when energized, causes certain appendages to the toys to move with respect to the toy. The movement of the appendages under the influence of the motor causes the toy to move across a support medium such as a support surface or the like. All of the toys are formed utilizing a kit-like set of components. The attachment of the individual components of the kit together is in a reversible manner, allowing for repeated assembly and disassembly of the toy at the whim and will of the user of the same. When so assembled, the toys are capable of exhibiting motion on a support surface and during assembly and disassembly, certain skills are gained by the user of the toy in practicing putting together and taking apart of the components.

Referring now to FIGS. 1 through 4, the first illustrative embodiment is shown and will be described in detail. As is evident from viewing FIG. 1, the toy 20 shown in this figure is composed of several component parts. The major component parts are a first and second body section 22 and 24, respectively. The two body sections 22 and 24 are in essence, mirror images of each other. They include a mating face 26 and 28, respectively, on the two body sections 22 and 24. When the toy 20 is assembled, the mating faces 26 and 28 fit flush against one another such that the individual body sections 22 and 24 together form a complete body (not separately numbered or identified) for the toy 20.

A spring wind-up motor 30 is positioned centrally in the two body sections 22 and 24. Each of the body sections 22 and 24 include a plurality of cradle projections, collectively identified by the numeral 32. As seen in FIG. 1, for the toy 20 there are four of these cradle projections 32 located on each of the body sections 22 and 24. When the body sections 22 and 24 are brought together with the motor 30 positioned in between them and the mating faces 26 and 28 are abutted next to each other in a juxtaposed position, the motor 32 becomes cradled in the cradle projections 32 and is fixedly held to the toy 20.

The body section 24 contains an opening 34 located near its frontmost surface. The body section 22 contains a projection 36 which is aligned with the opening 34 and when the body sections 22 and 24 are brought together in a mating relationship, the projection 32 projects through the opening 34 and a portion extends outwardly from the other side. A frictional locking member 38 fits over the end of the projection 36 exposed on the far side of the section 24 in FIG. 1, and fixedly engages this projection to lock the body sections 22 and 24 with respect to one another. In all of the embodiments illustrated in the other figures, at least one projection similar to the projection 36 exists and can be used to lock the body sections of those embodiments together.

A tail member 40 includes projections 42 and 44 located thereon. Each of the body sections 22 and 24 include an opening, collectively identified by the numeral 46, located at the rearmost extremity of the sections 22 and 24. Prior to mating the body sections 22 and 24, the tail member 40 is positioned with respect to one of the body sections such that one of the projections 42 or 44 go through one of the openings 46 and upon mating the two body sections 22 and 24 together, the other of the projections 42 or 44 goes through another of the openings 46 to fixedly hold the tail member 40 between the two body sections 22 and 24. When so positioned, a portion of each of the projections 42 and 44 extend beyond the openings 46. Locking caps, collectively identified by the numeral 48, are then frictionally fit over the end of the projections 42 and 44 to further assist in maintaining the body sections 22 and 24 in a mating position with respect to one another. The tail member 40 can be considered as an auxiliary joining member, capable of further assisting in maintaining the body sections 22 and 24 together.

A further joining member, "U" shaped member 50, fits over the top of the two body sections 22 and 24 after they have been mated together. The joining member 50 frictionally engages portions of the outside side surfaces of the body sections 22 and 24 to maintain the joining member 50 in position on the body sections 22 and 24 after they are joined and to further assist in maintaining them in a mating position.

Several decorative caps, collectively identified by the numeral 52, which externally appear similar to the locking member 38, are fit over projections collectively identified by the numeral 54 on various places on the two body sections 22 and 24. The decorative caps 52 are utilized for visual purposes only, and, while appearing similar in structure to the locking members 38, in fact serve no function with respect to holding the body sections 22 and 24 together. As is evident from viewing FIG. 1, the decorative cap 52*a* is structurally exactly the same as the locking member 38 and, in fact, these two could be interchanged for each other, except the locking member 38 serves a fastening function, while the decorative cap 52*a* simply serves as a facade member to complete the design of the toy 20.

On the bottom rear portion of the body sections 22 and 24, is a split projection 56 half of which is formed on body section 22 and half of which is formed on body section 24. There are a plurality of locking caps 48. One of the locking caps 48*a* fits over the split projection 56 after the two body sections 22 and 24 are mated, and this locking cap 48*a* then further assists in maintaining the body sections 22 and 24 in their mating relationship.

The motor 30 includes four axles, front axles 58*a* and *b*, and rear axles 60*a* and *b*, which are attached to the housing of the motor 30. When the motor 30 is cradled between the two mated body sections 22 and 24, the axles 58 and 60 extend out of the sides of the body sections 22 and 24. Front appendages 62*a* and *b*, and rear appendages 64*a* and *b* have bearing openings collectively identified by the numeral 66 which fit over the respective axles 58 and 60 and mount the appendages 62 and 64 to the main body of the toy 20. The appendages 62 and 64 are maintained on the axles 58 and 60 by the use of locking caps 48, which frictionally engage the axles 58 and 60 in a manner as previously described.

The output shaft of the motor 30 is shaped as a crank 68. The crank 68 extends on either side of the motor 30 and, on one side, engages the front appendage 62*a* and on the other side engages the front appendage 62*b*, by fitting into a slot 70 formed in each of the appendages 62*a* and *b*. As the crank 68 turns, this moves the appendages 62*a* and *b* about their respective axles 58*a* and *b*, such that the lower ends of the appendages 62 move back and forth in a walking-like manner.

The rear appendages 64 are formed as a bell crank with a slot 72 formed in one of their arms. The slot 72 fits over a peg 74 formed as a part of the front appendages 62. As the front appendage 62 moves under the influence of the crank 68, the motion of the front appendage 62 is transferred to the rear appendage 64 by the peg 74 fitting into the slot 72. This causes the rear appendages 64 to also move in a back and forth manner, as did the front appendage.

Each of the appendages 62 and 64 have a support block, collectively identifed by the numeral 76, shaped as a foot, which frictionally engages the end of each of the appendages 62 and 64 to be held thereon.

A head 78 includes an opening, (not numbered or shown) which fits over a peg 80 formed on body section 22. Two bearing members 82 fit onto pegs (not separately identified or numbered) projecting from the left and right hand sides of the heads 78, respectively. Two movable ears 84 fit into the bearing members 82 and are movable on the bearing members 82. The ears 84 include an arm 86 which projects inwardly and then inwardly and backwardly from each of the ears 83. Each of the front appendages 62 includes a slot 88 formed on the uppermost section of the appendage 62. The arm members 86 fit into the slots 88 and as the front appendages 62 move back and forth, this back and forth motion is transferred to the the ears 84 via the interaction of the arms 86 in the slots 88.

It can be seen as described above, that the individual components of the toy 20 are held together simply by frictional fit by certain of the components. The toy 20 can be assembled and disassembled at will, and when assembled, is capable of exhibiting motion under the influence of the output of the motor 30, and this motion is capable of moving the toy 20 across a support surface. For the embodiment of FIGS. 1 through 4, the motion is a walking-like motion which is achieved by having the individual sides of the crank 68 180° out of phase with respect to one another, such that, when one of the front appendages 62, as for example 62*a*, is moving forward, the other of the front appendages, 62*b*, is moving backward, and as the front appendage 62*a* moves forward, its corresponding rear appendage 64*a* moves backward. By having the rear appendage move toward and away from the front appendage on one particular side of the toy 20, coupled with the front appendages on the opposite sides of the toy 20 moving in opposite direction, a walking-like motion is achieved for the toy 20.

Figure 5:
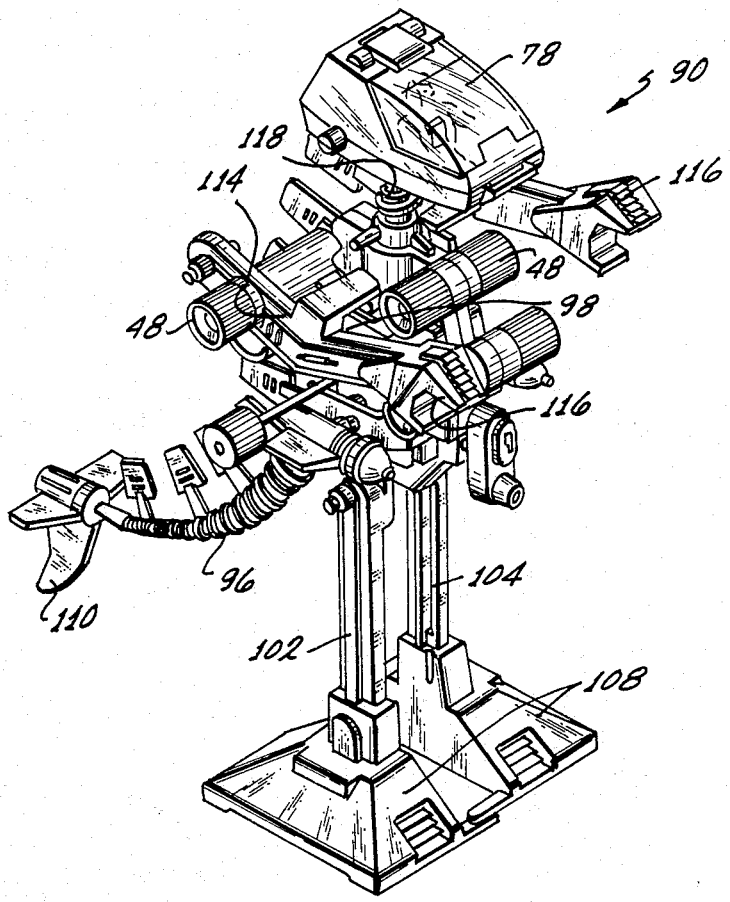
FIG. 5 is an alternate embodiment shown in oblique view.
Figure 6:
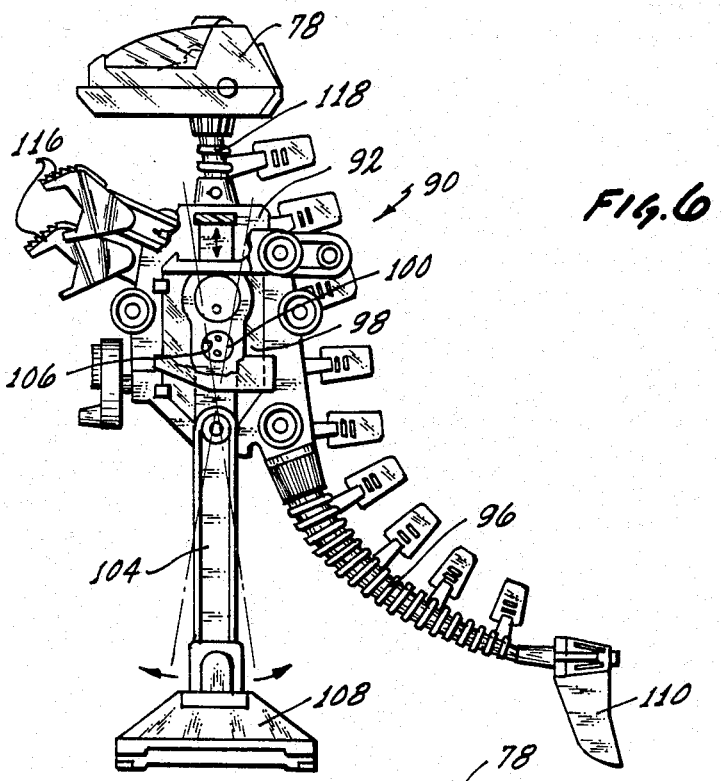
FIG. 6 is a side elevational view of the embodiment of FIG. 5 in partial section.
Figure 7:
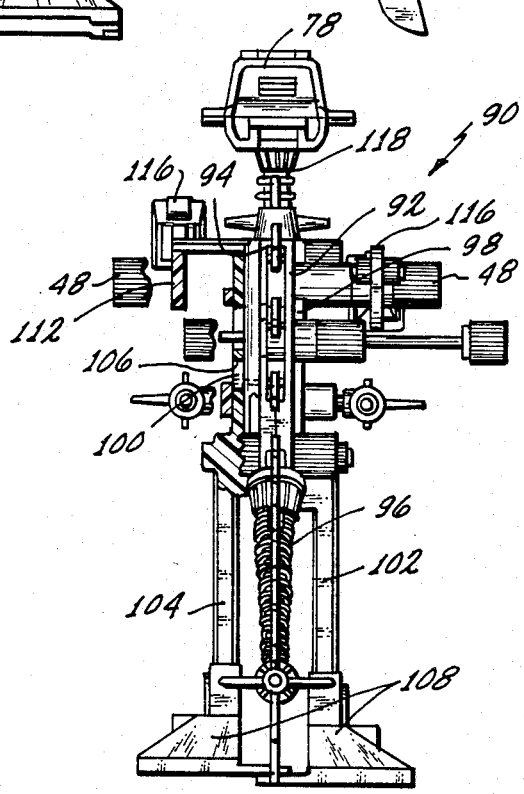
FIG. 7 is a front elevational view in partial section of the embodiment of FIG. 5.

Referring now to the embodiment of FIGS. 5, 6, and 7, there is shown a toy 90, which is also formed utilizing two body sections 92 and 94. These are held together in a manner exactly equivalent to the manner described for the toy 20, utilizing locking members similar to locking members 38 or locking caps identical to locking caps 48. Additionally, the toy 90 has a tail member 96, whose function is equivalent to that of the tail member 40 of the toy 20.

The motor 98 for the toy 90 has two crank disks collectively identified by the numeral 100 which are eccentrically placed on the output shaft of the motor 98. The upright appendages 102 and 104 of the toy 90 include openings collectively identified by the numeral 106 which fit around the respective crank disks 100. The interaction of the openings 106 over the crank disks 100 serves two functions. First, they serve as a bearing point for attachment of the upright appendages 102 and 104 to the toy 90 and secondly, they serve as a method of communication of motion from the motor 98 to the upright appendages 102 and 104.

The crank disks 100 on the respective sides of the toy 90 are located 180° out of phase with respect to their location on the output shaft of the motor 98. As such, in response to output of the motor 98, the individual upright appendages 102 and 104 are moved out of phase with respect to one another. That is, as the appendage 102 is moved forward under influence of rotation of its crank disk 100, the appendage 104 is moved backward under the influence of rotation of its crank disk 100. Additionally, as the crank disks 100 rotate, the individual appendages 102 or 104 are lifted slightly above the plane of the support surface on which the toy 90 rests and are moved up and over the other of the support blocks 108 located on the bottom of each of the appendages 102 and 104. The toy 90 is further supported by the end 110 of the tail member 96. As such, at rest the toy 90 is supported in a three point suspension and when the motor 98 is rotating, the toy 90 is alternately supported by the support block 108 on one of the upright appendages in combination with the end 110 of the tail member 96 and then supported by the support block 108 on the other of the upright appendages in combination with the end 110 of the tail member 96.

The toy 90 further includes cage members collectively identified by the numeral 112 which fit over projections, not numbered or seen, extending out of the individual sections 92 and 94 of the toy 90. The cage members 112 are held to these projections by locking caps 48 in a manner as described for the toy 20. The cage members 112 serve to hold the upright appendages 102 and 104 on their respective crank disks 100. Additionally, the cage members 112 include axles collectively identified by the numeral 114 on which upper appendages collectively identified by the numeral 116 are mounted. As the upper end of the upright appendages 102 and 104 move up and down with respect to rotation of the respective crank disks 100, these upper ends contact the upper appendages 116, causing them to move up and down concurrently.

The toy 90 further includes a head 78 which is interchangeable with the head of the toy 20. The head 78 fits on a neck member 118 which is mounted between the two sections 92 and 94 of the toy 90.

In FIGS. 8 and 9, a further embodiment, the toy 120, is shown. As with the other toys, 20 and 90, the toy 120 is formed of two body sections 122 and 124, respectively. These are held together with locking members equivalent to the member 38 or locking caps equivalent to the locking caps 48 and when so held together, cradle a motor 126 between them.

The sections 122 and 124 are further held together by a locking cap 128 which is equivalent to the locking cap 48*a*, previously described, in that it fits over a split projection, not numbered or seen, formed in part on section 122 and formed in part on section 124.

The toy 120 includes an axle 130 which passes through appropriate openings (not separately numbered or identified) in the sections 122 and 124. The axle 130 includes a wheel 132 which is molded as an integral component with the axle 130. Also molded as an integral component with the axle 130 is a gear 134 located just inside the wheel 132. A second wheel 136 frictionally fits over the end of the axle 130 after the axle 130 has been pushed through the openings in the sections 122 and 124. The wheel 136 frictionally fitting on the axle 130 serves to further maintain the sections 122 and 124 in a mating relationship with respect to one another.

The motor 126 of the toy 120 includes a gear 138 on its output shaft, which mates with a gear 140 which is rotatably mounted about an axle 142 molded on body section 122. The gear 140 transfers motion from the output gear 138 to the gear 134 which in turn rotates wheel 132 and axle 130 and rotation of the axle 130 is communicated to the wheel 136 such that the wheels 132 and 136 are rotated with respect to the rotary output of the motor 126.

Each of the wheels 136 and 132 have an extension collectively identified by the numeral 144 located on their outside surfaces. The extensions 144 are eccentrically located on the wheels 132 or 136. The extensions 144 pass through outboard members collectively identified by the numeral 146 and the outboard members 146 are held to the extensions 144 by locking caps 48. As the wheels 132 and 136 rotate, the outboard members 146 move in an orbit on the extension 144 because the extensions 144 are eccentrically located on the wheels 132 and 136. This eccentric orbit of the outboard members 146 gives them a walking-like appearance as the toy 120 moves across a support surface.

Two lobes, collectively identified by the numeral 148 are fixedly mounted on the wind-up shaft 150 of the motor 126. The motor 126, as per the other motors previously described, is energized by turning the wind-up shaft 150. As the motor 126 produces a rotary output after being so wound, the wind-up shaft 150 rotates in the opposite direction, which in turn orbits the lobes 148. Two wing members 152 and 154 are pivotally mounted to the respective sections 122 and 124. The wing members 152 and 154 rest against the lobes 148 and as the lobes 148 rotate, the lobes 148 alternately lift and then allow the wing members 152 and 154 to descend to give a flapping-like motion to the wing members 152 and 154 in response to the output of the motor 126 of the toy 120.

The toy 120 also includes a head 78, identical to the head 78 previously described.

As with the toy 20, the toy 90 and the toy 120 can be assembled and disassembled at will, and when assembled, can be activated by winding up the respective motors of the toys and allowing them to move across a support surface. In the toy 120, the wheels 132 and 136 act as appendages which are utilized in moving the toy 120 across the support surface. Additionally, the wing members 152 and 154, as well as the outboard members 146 act as auxiliary, or decorative appendages which move as the toy 120 moves, but do not serve as primary movers on moving the toy 120 across a support surface.

Portions of the mating faces on the respective body sections of the respective toys 20, 90 and 120 are flat and are capable of fitting against one another. Further portions of the mating faces are recessed inwardly to form recesses in each of the respective body sections of the toys 20, 90 and 120 allowing positioning of certain auxiliary joining members, such as tail member 40 of the toy 20 and tail member 96 of the toy 90 within these recesses when the respective body sections are mated to one another.

We claim:

1. A toy which comprises:

a body, said body having a first and a second body section, each of said first and said second body sections including a mating face, each of said mating faces complementary to the other of said mating faces such that said first and said second sections can be positioned in association with one another with their respective complementary mating faces in a juxtaposed position with respect to one another;

a motor capable of producing an output;

a motor cradle means, a portion of said motor cradle means locate on said first body section and the remaining portion located on said second body section, said portion of said motor cradle means located on said first body section including a first aperture and a first plurality of cradle projection members positioned around the periphery of said first aperture, said portion of said motor cradle means located on said second body section including a second aperture and a second plurality of cradle projection members positioned around the periphery of said second aperture, said motor positionable in said motor cradle means when said mating faces of said first and said second body sections are juxtaposed with respect to one another and a first portion of said motor extends through said first aperture with said first portion of said motor engaged by and held by said first plurality of cradle projection members and a second portion of said motor extends through said second aperture with said second portion of said motor engaged by and held by said second plurality of cradle projection members, said motor releasable from said motor cradle means when said mating faces are distal from one another;

at least one fastening means capable of reversible fixing said mating faces of said first and said second body sections in said juxtaposed position with respect to one another, said fastening means including said second body section having an opening through its mating face and further including a first and second joining member, said first joining member comprising an elongated means integrally formed as a part of said first body section, said elongated means located on said first body section in a position so as to pass through and partially extend beyond said opening in said second body section when said mating faces are juxtaposed to one another;

said second joining member comprising a push on cap having a cavity therein and a single orifice opening into said cavity, said cavity capable of frictionally engaging said portion of said elongated means which extends beyond said opening in said second body section when said elongated means is positioned within said opening in said second body section;

at least one appendage member movably connected to said body and operatively associates with said motor, said appendage member capable of moving with respect to said body in response to said output of said motor, movement of said appendage member with respect to said body moving said toy with respect to a support medium.

2. The toy of claim 1 further including:

an auxiliary joining member structurally independent from said first and said second body sections capable of interacting with both said first and said second body sections to further contribute to maintaining said mating faces in said juxtaposed positions.

3. The toy of claim 2 including:

at least two appendage members movably connected to said body and each operatively associated with said motor and capable of moving with respect to said body in response to said output of said motor, movement of said appendage members with respect to said body capable of moving said toy with respect to a support medium.

4. The toy of claim 3 including:

a plurality of said fastening means.

5. The toy of claim 4 wherein:

at least a portion of each of said mating faces is flat, said flat portion located on said respective mating faces such that when said mating faces are juxtaposed with respect to one another said flat portions are positionable against one another.

6. A toy which comprises:

a body, said body having a first and second body section, each of said first and said second body sections including a mating face, each of said mating faces complementary to the other of said mating faces such that said first and said second body sections can be positioned in association with one another with their respective complementary mating faces in a juxtaposed position with respect to one another;

a motor capable of producing an output;

a motor cradle means, a portion of said motor cradle means located on said first body section and the remaining portion located on said second body section, said motor cradle means capable of holding said motor in a fixed position with respect to said first and said second body sections when said mating faces are juxtaposed with respect to one another and releasing said motor when said mating faces are distal from one another;

at least one fastening means capable of reversibly fixing said mating faces of sad first and said second body sections in said juxtaposed position with respect to one another, said fastening means including said second body section having an opening through its mating face and further including a first and second joining member, said first joining member comprising an elongated means integrally formed as a part of said first body section, said elongated means located on said first body section in a position so as to pass through and partially extend beyond said opening in said second body section when said mating faces are juxtaposed to one another;

said second joining member having an opening capable of frictionally engaging said portion of said elongated means which extends beyond said opening when said elongated means is positioned within said opening;

at least one appendage member movably connected to said body and operatively associates with said motor, said appendage member capable of moving with respect to said body in response to said output of said motor, movement of said appendage member with respect to said body moving said toy with respect to a support medium;

an auxiliary joining member structurally independent from said first and said second body sections capable of interacting with both said first and said second body sections to further contribute to maintaining said mating faces in said juxtaposed positions;

said auxiliary joining member including two of said first joining members located thereon, each of said first and said second body sections having an auxiliary opening, each of said mating faces of said first and said second body section further having a recessed portion therein capable of fitting around a portion of said auxiliary joining member such that together said recessed portions allow positioning of said auxiliary joining member between said first and said second body sections when said mating faces are juxtaposed to one another and one of said first joining members on said auxiliary member passes through the auxiliary opening on one of said body sections and the other of said first joining members on said auxiliary member passes through the auxiliary opening in the other of said body sections;

two second joining members capable of frictionally fitting over said two first joining members on said auxiliary member.

7. The toy of claim 6 wherein:

said cradle means comprises each of said first and said second body sections each having at least one cradle member formed as a part of said body sections and capable of engaging against a portion of said motor when said mating faces are juxtaposed to one another.

* * * * *

UNITED STATES PATENT AND TRADEMARK OFFICE

CERTIFICATE OF CORRECTION

PATENT NO. : 4,515,571

DATED : MAY 7, 1985

INVENTOR(S) : M. KOZUK AND M. TONOKURA

It is certified that error appears in the above-identified patent and that said Letters Patent is hereby corrected as shown below:

Column 4, line 18, "32" should read --30--.

Column 4, line 25 "32" should be --36--.

Column 5, line 60 "heads" should be --head--.

Column 8, line 50 "locate" should be --located--.

Column 9, line 29 "associates" should read --associated-.

Column 10, line 30 "associates" should be --associated--.

Column 10, line 11 "sad" should read --said--.

Signed and Sealed this

*Twenty-second* Day of *October 1985*

[SEAL]

*Attest:*

DONALD J. QUIGG

*Attesting Officer*

*Commissioner of Patents and Trademarks—Designate*